US005112022A

United States Patent [19]

Cardas

[11] Patent Number: 5,112,022

[45] Date of Patent: May 12, 1992

[54] FRAME HANGER

[75] Inventor: Alberto T. Cardas, Madrid, Spain

[73] Assignee: Colis Internacional, S.A., Madrid, Spain

[21] Appl. No.: 671,381

[22] Filed: Mar. 19, 1991

[51] Int. Cl.[5] ..... A47G 1/16

[52] U.S. Cl. ..... 248/493; 248/547

[58] Field of Search ..... 248/547, 493, 216.4, 248/216.1, 489; 81/44; 411/41, 60

[56] References Cited

U.S. PATENT DOCUMENTS

| | | | |
|---|---|---|---|
| 406,255 | 7/1889 | Brinkerhoff | 248/493 |
| 2,642,242 | 6/1953 | Karitzky | 248/547 X |
| 3,599,686 | 8/1971 | Peebles | 248/547 X |
| 3,789,895 | 2/1974 | Levinson | 81/44 |
| 4,094,490 | 6/1978 | Einhorn | 411/41 X |
| 4,455,756 | 6/1984 | Greene | 248/547 X |
| 4,655,423 | 4/1987 | Schavilje | 248/216.1 X |
| 5,018,697 | 5/1991 | Treanor | 248/489 X |

FOREIGN PATENT DOCUMENTS

| | | | |
|---|---|---|---|
| 2315364 | 1/1977 | France | 81/44 |
| 302565 | 12/1928 | United Kingdom | 248/547 |

*Primary Examiner*—J. Franklin Foss
*Attorney, Agent, or Firm*—Whitham & Marhoefer

[57] ABSTRACT

A frame hanger (1) is provided which includes a plastic element in the form of a hook which includes a base portion (13) in the region where it attaches to a wall. The frame hanger also includes a nail (2) which is frictionally engaged by a passage formed longitudinally through the frame hanger for attachment to the wall. The nail initially protrudes only from the front of the frame hanger in order that the base portion may initially be placed firmly in contact with the wall. The frame hanger is attached to the wall by driving the nail (2) through the frame hanger and into the wall until the nail does not protrude from the front of the frame hanger. An auxiliary plate (3) is provided to assist in holding the frame hanger in position against the wall during driving of the nail. The body of the frame hanger includes a cylindrical portion (11), a widened portion (13) at the base and a salient portion (12) at the opposing end of the cylindrical body.

4 Claims, 1 Drawing Sheet

FRAME HANGER

BACKGROUND OF THE INVENTION

1. Field of the Invention

The present invention relates to a frame hanger and, more particularly, to a frame hanger which may be readily attached to a wall or other surface.

2. Description of the Prior Art

Numerous types of devices are known in the art to facilitate the hanging of objects such as framed pictures or clothing on vertical surfaces such as walls or other surfaces. However, in order to install such known devices, it has been necessary to make an orifice or aperture in the wall as a separate step in preparation for affixing the device thereto. Depending upon the construction of the wall, it is often also necessary to insert some additional device into the wall for purposes of reinforcement at the aperture and to allow the material of which the wall is constructed to firmly grasp a portion of the hanger device. Such known inserts have taken the form of plastic or soft metal shields, toggle-bolts and the like. Such inserts also cause the dimensions of the aperture to be critical and thus the apertures must be formed with a drill of an exact size. Furthermore, since these devices are available in a number of sizes, numerous drills, insert devices and other cooperating and accurately sized hardware, such as screws, must be available at the same time for installation to be correctly completed. While the different necessary hardware complicates the installation, such complication provides opportunity for errors and unnecessary damage to the wall.

Further, there are many occasions when the hanger will only be required to bear a small weight and, in such cases, it is often desirable to be able to remove and relocate the hanger. In such cases, hangers using inserts such as the ones described above leave relatively large, unsightly damage visible on the wall at the location from which the hanger has been removed. It is also often difficult or impossible to remove the inserts from the wall and the retention of the insert device thus complicates repair of the wall surface.

In this latter case, such hangers are often used for the suspension of decorations such as placards or other wall hangings. In such a case, it is also desirable that the hanger device itself be of very small dimensions, which further complicates installation in the handling of small parts and application of tools to them, particularly when the hanger is installed by driving with a hammer.

Further, many types of hanger hardware known in the art provide an offset between the point at which the hanger device is attached to the wall and the portion which will support the weight of an object suspended therefrom. Such offsets are, in practice, difficult to estimate and often require several attempts at installation before the exact location of the hanger can be made to coincide with the position desired, causing further damage to the wall and increasing installation time.

Accordingly, it is seen that hanger devices known in the art have numerous disadvantages with regard to practical usage thereof. Such disadvantages include the requirement for additional coordinated hardware and tools, difficulty in positioning and relocating the hanger device, damage to the surface on which the hanger device is installed and difficulty in the manipulation of numerous small parts.

SUMMARY OF THE INVENTION

It is therefore an object of the present invention to provide a hanger device which can be easily and precisely located and installed as well as having the ability to be relocated without significant visible damage to the wall.

It is another object of the present invention to provide a means for assisting in the handling of the hanger device according to the invention.

It is a further object of the invention to provide a frame hanger which may be precisely located at a desired position on a wall or other vertical surface and immediately affixed thereto without the necessity of further relative movement between the hanger device and the vertical surface.

In order to satisfy the foregoing and other objects of the invention, a frame hanger is provided having a body including a hook portion, a base portion and a salient portion, a passage extending longitudinally through the body and attachment means initially positioned in frictional engagement with the passage and extending from a front surface of said salient portion by a significantly greater distance than from a rear surface of said base portion to facilitate installation.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

Figure 1A:
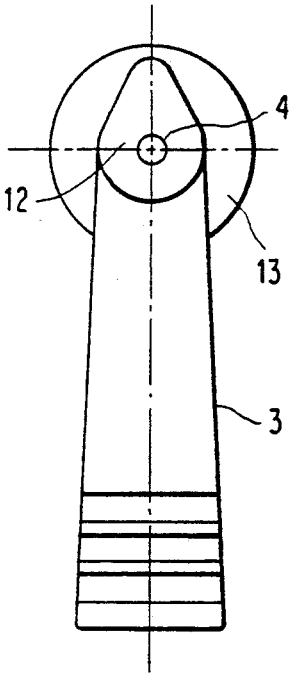
FIG. 1*a* is a view of the frame hanger and auxiliary plate according to the invention in the axial direction of the attachment means.

Referring now to the drawings, and more particularly to FIG. 1*a*, there is shown a view of the frame hanger 1 according to the present invention along the axial direction of the attachment means such as a nail 2. The body of the frame hanger 1 comprises a generally cylindrical portion 11 terminated at one end by a widened generally disk-shaped base portion 13 which, as shown in partial cut-away section of FIG. 1*b*, can be formed in a generally concave manner in a region where it will abut the wall or other surface. The interior of the cylindrical portion 11 is formed with a preferably round passage 4 in the interior through which the attachment means 2 passes during installation. The passage and attachment means can also be formed with a keyway or with a polygonal cross-sectional form to resist rotation of the cylindrical body 11 around the attachment means 2 if an impact-driven attachment means is used. However, it is deemed preferable that rotation be resisted by frictional engagement between the frame hanger and the attachment means. The body of the frame hanger 1, at the end of the cylindrical portion 11 which is opposite the base portion 13 includes a salient portion 12 preferably in the form of a hook. The base portion 13, cylindrical portion 11 and hook salient portion 12 are preferably formed as a single unit which can, for example, be molded from a plastic or ceramic material or cast of metal.

Figure 1B:
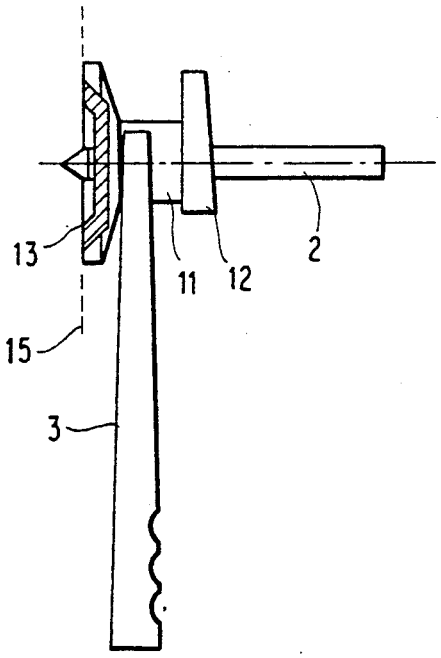
FIG. 1*b* shows a view of the hanger device and auxiliary plate according to the present invention from a direction perpendicular to the axial direction of the attachment means.

Referring now to FIG. 1*b*, attachment means 2 is shown at a position in which it is placed prior to the operation of attaching the frame hanger to a surface. It is preferred that there will be a substantial frictional engagement between the attachment means 2, which is preferably in the form of a nail, and the interior of the passage 4 in the frame hanger body constituted by the cylindrical portion 11, base portion 13 and hook portion 12. This is preferably achieved by forming the passage such that a slight interference fit will occur between the attachment means and the passage will occur. Alternatively, a viscous material or a material such as paint, lacquer or glue may be used to form a temporary attachment between the attachment means and the frame hanger body. In this case, the temporary attachment is naturally broken when the nail is driven.

It is also preferable that the attachment means initially protrude from the rear surface of the base portion 13 by only a small distance, as shown, if at all. This positioning, in combination with the frictional engagement between the frame hanger body and the attachment means, allows the frame hanger to be accurately positioned against the surface in an exactly determinable position. Also, the attachment means is firmly held in place by the frictional engagement with the body portion during the initial positioning of the frame hanger and can be arranged to assist in maintaining the location until the attachment means 2 can be driven. It should be noted that the frame hanger 1 need not be moved from the determined position while the attachment means 2 is driven into engagement with the surface either by impact of a hammer, in the preferred embodiment or by torsion such as with a screwdriver if a screw is used as an attachment means. In this latter case, if a screw is used, installation can often be facilitated by initially driving the screw a short distance by impact before applying torsional force thereto. In this way, the cooperation between the parts of the invention remains the same, regardless of the type of attachment means chosen.

Preferably, attachment means 2 takes the form of a metallic cylindrical nail which may be of a diameter of some few millimeters and which is sharply pointed in a conical portion at the end thereof. The sharpness of this point and together with a slight protrusion from the base portion 13 is helpful in resisting movement from the position selected for installation. The form of the nail can also enhance the frictional engagement between the nail and the cylindrical body 11 by providing a slight effective increase in the nail diameter (e.g. by tapering or knurling) at the end opposite the point. This slight effective increase in diameter can also be provided by deformation of the nail during installation.

It should be noted that the attachment means 2 enters the surface on which the frame hanger is to be mounted, generally indicated by dashed line 15 in FIG. 1*b*, substantially perpendicularly thereto, thereby minimizing damage to the surface as by the chipping of plaster or the displacement of wood fibers as would occur if the attachment means were driven at an acute angle to the surface. The firm engagement between the attachment means 2 and the hanger body including the flat base portion 13 abutting the surface has the effect of distributing lateral forces applied to the frame hanger over a relatively larger area of the wall. Bending of the attachment means is resisted by support provided by passage 4 in cylindrical body 11. Therefore, even a relatively small frame hanger in accordance with the invention can support a relatively significant weight on the order of 20 kilograms while minimizing the diameter of the attachment means, thus also minimizing wall damage.

Figure 2:
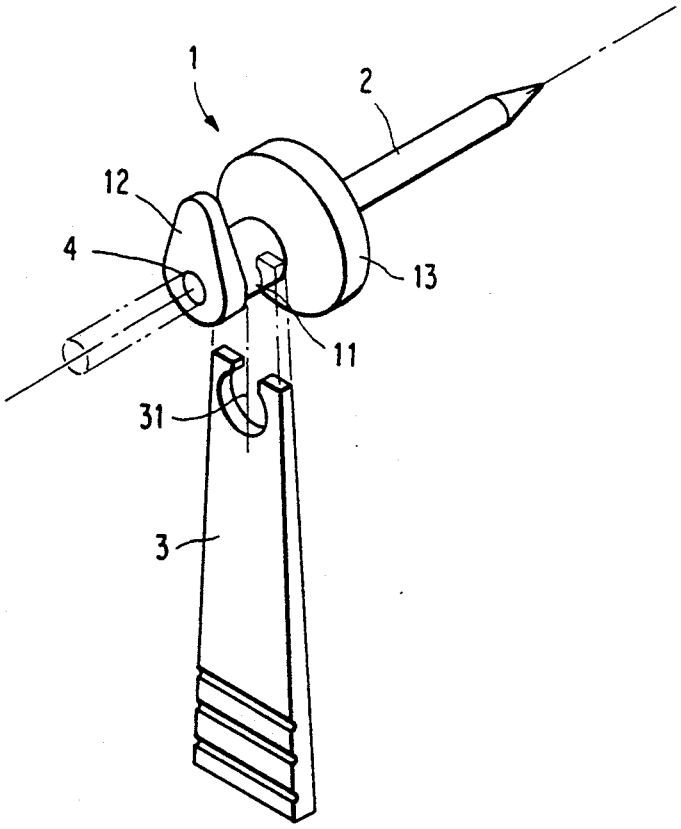
FIG. 2 is an isometric view of the frame hanger and auxiliary plate according to the invention which particularly shows the motion of the attachment means during installation of the frame hanger.

As the frame hanger in accordance with the invention is made smaller for some applications, the convenience provided by the auxiliary plate 3 is increased in the handling of such smaller parts. The auxiliary plate 3 is preferably formed of a resilient material such as plastic or Nylon TM and is elongated in shape similar to the exemplary form shown in FIGS. 1 and 2. As particularly shown in FIG. 2, the auxiliary plate 3 may have grooves or other roughening surface treatment at one end to assist in gripping of the auxiliary plate. At the opposite end of the auxiliary plate, a semicircular aperture 31 is preferably formed. This aperture will preferably extend slightly beyond the diameter of the cylindrical portion 11 of the frame hanger 1. The resilience of the auxiliary plate 3 allows the auxiliary plate to be snap fit to the cylindrical portion of the frame hanger and to firmly grip the same. The sides of the auxiliary plate are preferably formed relatively thinly, as shown, to allow the auxiliary plate to be removed from the body of the frame hanger by a simple twisting motion.

During the attachment operation, the frame hanger can be preferably held in place by means of auxiliary plate 3. This feature of the invention is particularly useful when the frame hanger is formed at a small size. The auxiliary plate 3 can assist in the avoidance of injury when the attachment means is driven into engagement with the wall by impact as well as reducing the tendency to drop small parts. In this regard, while the nail is held by the body of the frame hanger, it effectively increases the visibility of the nail, reducing the tendency for nails to be lost, if dropped. The attachment of the auxiliary plate 3 further enhances this effect.

Since the auxiliary plate is preferably formed of a resilient material and can be attached to and removed from a frame hanger body at will, the auxiliary plate is reusable. Thus, for purposes of marketing the frame hanger according to the invention, it would only be necessary to provide a single auxiliary plate for any desired number of frame hangers of a common size which may be packaged together in a packet or case, as may be desired. It should also be noted that if the part of the salient portion 12 which adjoins the cylindrical portion 11 of the frame hanger is of relatively the same diameter as the cylindrical portion, either a rigid or resilient auxiliary plate can be assembled with the frame hanger body over the end of the salient portion 12, as well, and removed along the same path.

In view of the foregoing, it is seen that the frame hanger according to the invention provides a hanger device which can be easily and accurately positioned on a surface and immediately installed without relative motion between the hanger device and that surface. The frame hanger and attachment means can be easily manipulated, particularly by means of auxiliary plate 3. The installer can thus rapidly install the frame hanger with a minimum risk of injury even when the hanger device is of small size and the attachment means is to be driven into engagement with a wall by impact. The perpendicular engagement of the attachment means with the surface minimizes visible damage to the surface if the frame hanger is removed and/or relocated.

While the invention has been described in terms of a single preferred embodiment, those skilled in the art will recognize that the invention can be practiced with modification within the spirit and scope of the appended claims.

Having thus described my invention, what I claim as new and desire to secure by Letters Patent is as follows:

1. A frame hanger having a body including a hook portion, a base portion and a salient portion, said body having a passage longitudinally extending through said body, said frame hanger further including attachment means initially positioned in frictional engagement with said passage and extending from a front surface of said salient portion by a significantly greater distance than from a rear surface of said base portion, whereby said base portion may be placed against a surface and the frame hanger affixed to said surface by driving said attachment means through said aperture into said surface.

2. A frame hanger as recited in Claim 1 wherein said body is generally cylindrical, and said base portion is in the form of a disk which is wider than said salient portion, and wherein said passage is generally orthogonal to a plane defined by said rear surface of said base portion.

3. A frame hanger as recited in claim 1, further including an auxiliary plate formed of a resilient material and having a semicircular aperture formed at a peripheral portion thereof, said semi-circular aperture being dimensioned to extend around a major portion of a periphery of said body when assembled with said frame hanger.

4. A frame hanger as recited in claim 2, further including an auxiliary plate formed of a resilient material and having a semicircular aperture formed at a peripheral portion thereof, said semi-circular aperture being dimensioned to extend slightly beyond a diameter of said body when assembled with said frame hanger.

* * * * *